US011466514B2

(12) United States Patent
Bohlen et al.

(10) Patent No.: US 11,466,514 B2
(45) **Date of Patent: *Oct. 11, 2022**

(54) ROLLER SHADE WITH A COUNTERBALANCING DEVICE

(71) Applicant: Hunter Douglas Industries B.V., Rotterdam (NL)

(72) Inventors: Jörg Bohlen, Langen (DE); Lars Koop, Bremerhaven (DE)

(73) Assignee: Hunter Douglas Industries B.V., Rotterdam (NL)

( * ) Notice: Subject to any disclaimer, the term of this patent is extended or adjusted under 35 U.S.C. 154(b) by 943 days.

This patent is subject to a terminal disclaimer.

(21) Appl. No.: 16/174,993

(22) Filed: Oct. 30, 2018

(65) Prior Publication Data

US 2019/0128063 A1 May 2, 2019

Related U.S. Application Data

(63) Continuation of application No. 14/380,890, filed as application No. PCT/NL2013/000008 on Feb. 27, 2013, now Pat. No. 10,138,676.

(30) Foreign Application Priority Data

Feb. 27, 2012 (NL) ..... 1039408

(51) Int. Cl.
*E06B 9/60* (2006.01)
*E06B 9/56* (2006.01)
(Continued)

(52) U.S. Cl.
CPC ..... *E06B 9/56* (2013.01); *E06B 9/42* (2013.01); *E06B 9/50* (2013.01); *E06B 9/60* (2013.01);
(Continued)

(58) Field of Classification Search
CPC ..... E06B 9/40; E06B 9/60; E06B 9/62; E06B 9/56; E06B 9/50; E06B 9/42; E06B 9/90; E06B 2009/425
See application file for complete search history.

(56) References Cited

U.S. PATENT DOCUMENTS 1,726,589 A 9/1929 Schultes
4,466,475 A * 8/1984 Saito ..... E06B 9/90 160/297
(Continued)

FOREIGN PATENT DOCUMENTS

CA 1301052 5/1992
CN 201152134 11/2008
(Continued)

OTHER PUBLICATIONS

PCT International Search Report dated Jun. 25, 2013 for International Application No. PCT/NL2013/000008, 4 pages.

*Primary Examiner* — Johnnie A. Shablack
*Assistant Examiner* — Jeremy C Ramsey
(74) *Attorney, Agent, or Firm* — Dority & Manning, P.A.

(57) ABSTRACT

A counterbalancing device for a roller shade having a flexible sheet member and a roller shaft coupled to the flexible sheet member includes a stationary rod extending within the roller shaft, with the rod including a first end and a second end opposite the first end. The counterbalancing device also includes a rod adjuster coupled to the first end of the stationary rod and a spring winder positioned adjacent to the first end of the stationary rod. The rod adjuster is configured to selectively rotate the stationary rod and the spring winder is configured to rotate with the roller shaft. Additionally, the counterbalancing device also includes a spring having a first spring end coupled to the spring winder such that the first spring end rotates with the spring winder,
(Continued)

and a second spring end coupled to the stationary rod such that the second spring end rotates with the stationary rod.

22 Claims, 7 Drawing Sheets

(51) Int. Cl.

| | |
|---|---|
| ***E06B 9/50*** | (2006.01) |
| ***E06B 9/90*** | (2006.01) |
| ***E06B 9/62*** | (2006.01) |
| ***E06B 9/42*** | (2006.01) |

(52) U.S. Cl.
CPC ..... *E06B 9/62* (2013.01); *E06B 9/90* (2013.01); *E06B 2009/425* (2013.01)

(56) References Cited

U.S. PATENT DOCUMENTS

| | | | | |
|---|---|---|---|---|
| 4,523,620 | A | 6/1985 | Mortellite | |
| 4,884,618 | A * | 12/1989 | Steeves | E06B 9/60 160/321 |
| 5,031,682 | A | 7/1991 | Tedeschi | |
| 5,119,868 | A | 6/1992 | Werner | |
| 6,123,140 | A | 9/2000 | Bergamaschi | |
| 6,467,714 | B1 | 10/2002 | Rasmussen | |
| 6,536,503 | B1 | 3/2003 | Anderson et al. | |
| 6,644,378 | B2 | 11/2003 | Mitchell | |
| 7,665,505 | B2 | 2/2010 | McCormick et al. | |
| 7,793,701 | B2 | 9/2010 | Liang et al. | |
| 9,957,752 | B2 * | 5/2018 | Bohlen | E06B 9/50 |
| 2004/0123960 | A1 | 7/2004 | Jorgensen et al. | |
| 2005/0072635 | A1 | 4/2005 | Toti | |
| 2005/0205224 | A1 | 9/2005 | Dalle Nogare et al. | |
| 2009/0020240 | A1 | 1/2009 | Liang | |
| 2009/0159221 | A1 | 6/2009 | Liang | |
| 2009/0308546 | A1 | 12/2009 | Liang et al. | |
| 2011/0297334 | A1 | 12/2011 | Bohlen et al. | |
| 2013/0153161 | A1 * | 6/2013 | Haarer | E06B 9/68 160/293.1 |
| 2013/0020038 | A1 | 12/2013 | Barnes et al. | |
| 2014/0096920 | A1 | 4/2014 | MacDonald | |

FOREIGN PATENT DOCUMENTS

| | | |
|---|---|---|
| EP | 0887507 | 12/1998 |
| GB | 500451 | 2/1939 |
| WO | WO2008150789 | 12/2008 |
| WO | WO2010089118 | 8/2010 |
| WO | WO2011090975 | 7/2011 |

* cited by examiner

ROLLER SHADE WITH A COUNTERBALANCING DEVICE

CROSS-REFERENCE TO RELATED APPLICATIONS

The present application is a continuation of U.S. patent application Ser. No. 14/380,890 filed on Aug. 25, 2014, which, in turn, is a national phase application of PCT International Application No. PCT/NL2013/000008, filed on Feb. 27, 2013, which, in turn, is based upon and claims the right of priority to NL Application No. 1039408, filed on Feb. 27, 2012, the disclosures of all of which are hereby incorporated by reference herein in their entirety for all purposes.

FIELD

The invention relates to a roller shade including a flexible sheet member for selective covering of an architectural opening. In particular the invention relates to such roller shades that do not require any braking devices or operating cords.

BACKGROUND

Roller shades of this kind have been disclosed in patent documents U.S. Pat. Nos. 6,536,503 and 7,665,505. While being genuine efforts of eliminating operating cords and braking devices, the proposed devices have tended to be rather complicated and difficult in adapting to different sizes of shades with respect to heights and widths. It has also been proposed in patent application document WO 2010/089118 to provide a helically wound spring as an additional assisting device in cord and motor operated window coverings. However it was not recognised that this spring assist device would be suitable for roller shades that are devoid of additional braking devices, such as clutches and friction increasing means, or operating mechanisms, such as operating cords.

It has further been observed with the known roller shades that a stop that limits upward travel would be desirable, but was difficult to combine with known torque accumulating mechanisms, or to be adjusted.

Yet another concern has been the fine adjustment or readjustment of the known torque accumulating mechanisms for production tolerances or wear, which has been generally impossible to achieve.

Accordingly it is an object of the present invention to propose an improved operating mechanism for an extendable and retractable roller shade for architectural openings. In a more general sense it is thus an object of the invention to overcome or ameliorate at least one of the disadvantages of the prior art. It is also an object of the present invention to provide alternative structures which are less cumbersome in assembly and operation and which moreover can be made relatively inexpensively. Alternatively it is an object of the invention to at least provide the public with a useful choice.

SUMMARY

To this end the invention provides a roller shade as defined in one or more of the appended claims. The thus proposed roller shades can be balanced in every desired position by means of only a helically wound tension spring. This has proven to be possible without additional brake, clutch, or like friction increasing devices. In a particular embodiment an adjustable upward travel limiting stop is also provided. The feature of the adjustable upward travel limiting stop is not necessarily limited to balanced roller shades only and may also successfully be used in conjunction with a spring force driven roller shade.

BRIEF DESCRIPTION OF THE DRAWINGS

Further advantageous aspects of the invention will become clear from the appended description and in reference to the accompanying drawings, in which.

DETAILED DESCRIPTION

Figure 1:
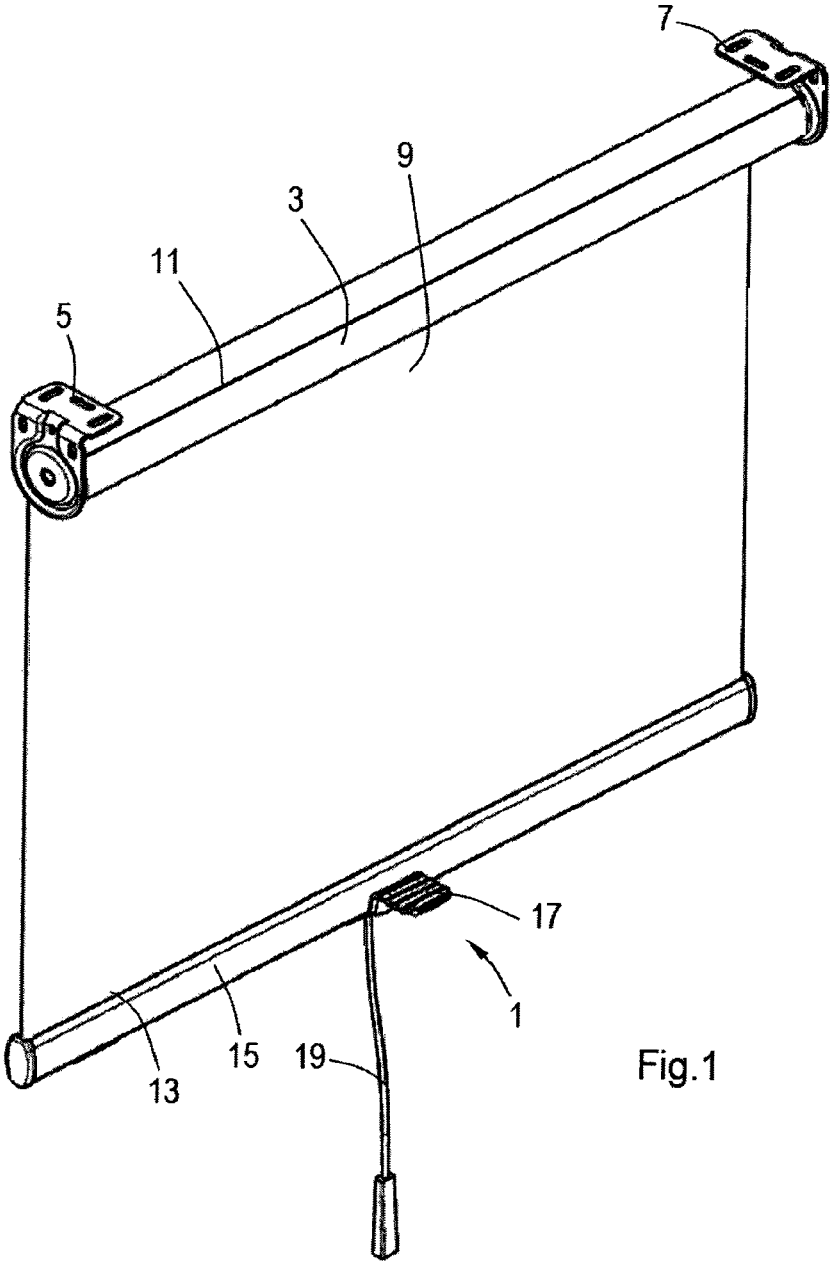
FIG. 1 is an isometric view of a roller shade according to the invention.

Referring first to FIG. 1, there is shown a roller shade 1 that has a roller shaft 3 mounted for rotation between first and second mounting brackets 5, 7. A flexible sheet member 9 has opposite parallel first and second edges 11, 13. The flexible sheet member 9 is attached along its first parallel edge 11 to the roller shaft 3 in a longitudinal direction thereof. The second parallel edge 13 has a bottom bar 15 attached therealong. The bottom bar 15 preferably adds some weight to the portion of the sheet member 9 that is depending from the roller shaft 3. Optionally the bottom bar 15 may be provided with handle 17 and/or a cord pull 19 for manually grasping the bottom bar 15 for raising and lowering the flexible sheet member 9. The cord pull 19, or an operating wand, may only be necessary for window applications that will put the bottom bar 15 out of reach of an operating person. In general a fully raised position of the roller shade 1 will be defined when the flexible sheet member 9 is fully wound about the roller shaft 3, and a fully lowered position will be defined when the flexible sheet member 9 is fully unwound from the roller shaft 3, as shown in FIG. 1.

Figure 2:
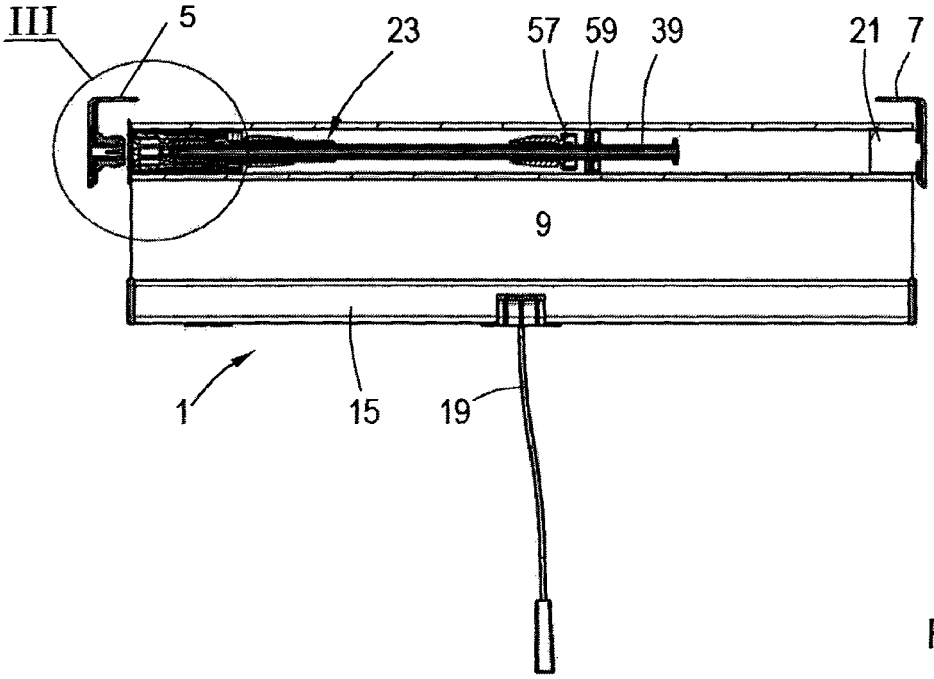
FIG. 2 is a longitudinal cross section over the roller shaft of the roller shade of FIG. 1.
Figure 3:
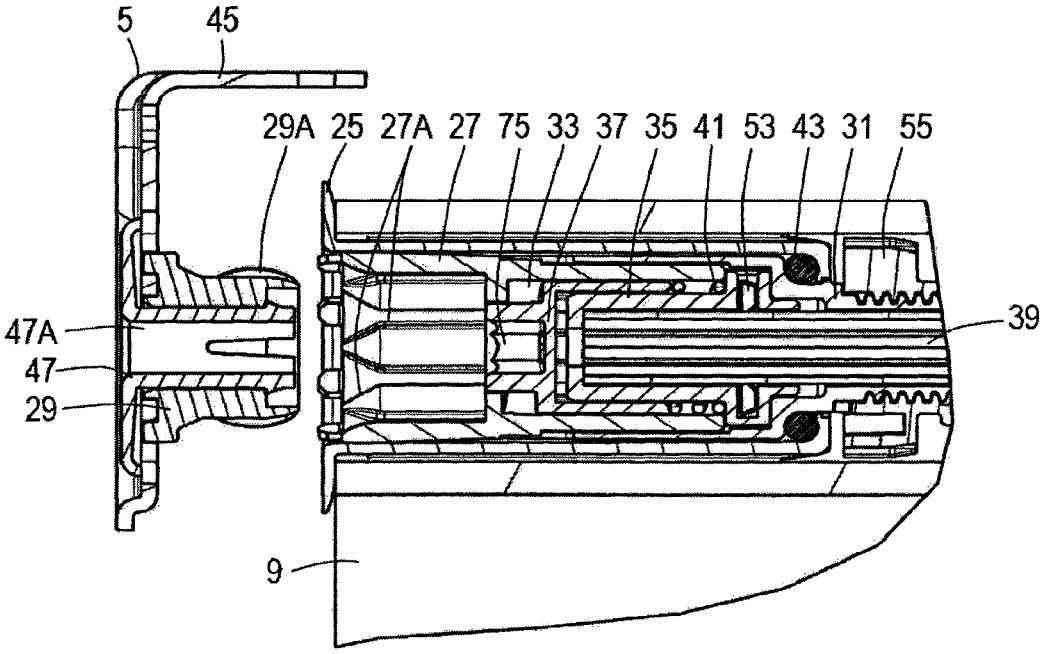
FIG. 3 is an enlarged detail view of the portion indicated III in FIG. 2.

In FIG. 2 an elevation of the roller shade 1 of FIG. 1 is shown with the roller shaft 3 shown in longitudinal cross section. At one longitudinal end the roller shaft 3, which is seen to be hollow, engages the second mounting bracket 7 with an idle plug 21 that allows unhindered rotation with respect to the second mounting bracket 7. The first mounting bracket 5 is shown in a detached position with respect to the other longitudinal end of the roller shaft 3. In use the first mounting bracket 5 will engage a counter balancing device 23 that is accommodated within the hollow interior of the roller shaft 3. An enlarged detail of the engagement of this other longitudinal end of the roller shaft 3 with the first mounting bracket 5 is shown in FIG. 3.

A roller shaft end plug 25 non-rotatably engages the roller shaft 3, and is rotatably journalled on a bracket connector plug 27 which thereby forms a bearing for the end plug 25. The bracket connector plug 27 can engage a bracket adapter 29 on the first mounting bracket 5. The bracket connector plug 27 is non-rotatably held to the bracket adapter 29 by inter engaging ribs and serrations 27A, 29A that will also create incremental angular adjustment positions. The bracket connector plug 27 together with a threaded shaft member 31 defines an adjuster cavity 33 that houses a rod adapter 35 and a rod adjuster 37, which will be described in more detail herein below. The rod adapter 35 non-rotatably engages a central stationary rod 39.

A compression spring 41 urges the rod adjuster 37 away from the rod adapter 35. It is further seen in FIG. 3 that a ball bearing 43 is interposed between the threaded shaft member 31 and the roller shaft end plug 25 to reduce friction upon relative rotation.

Figure 4:
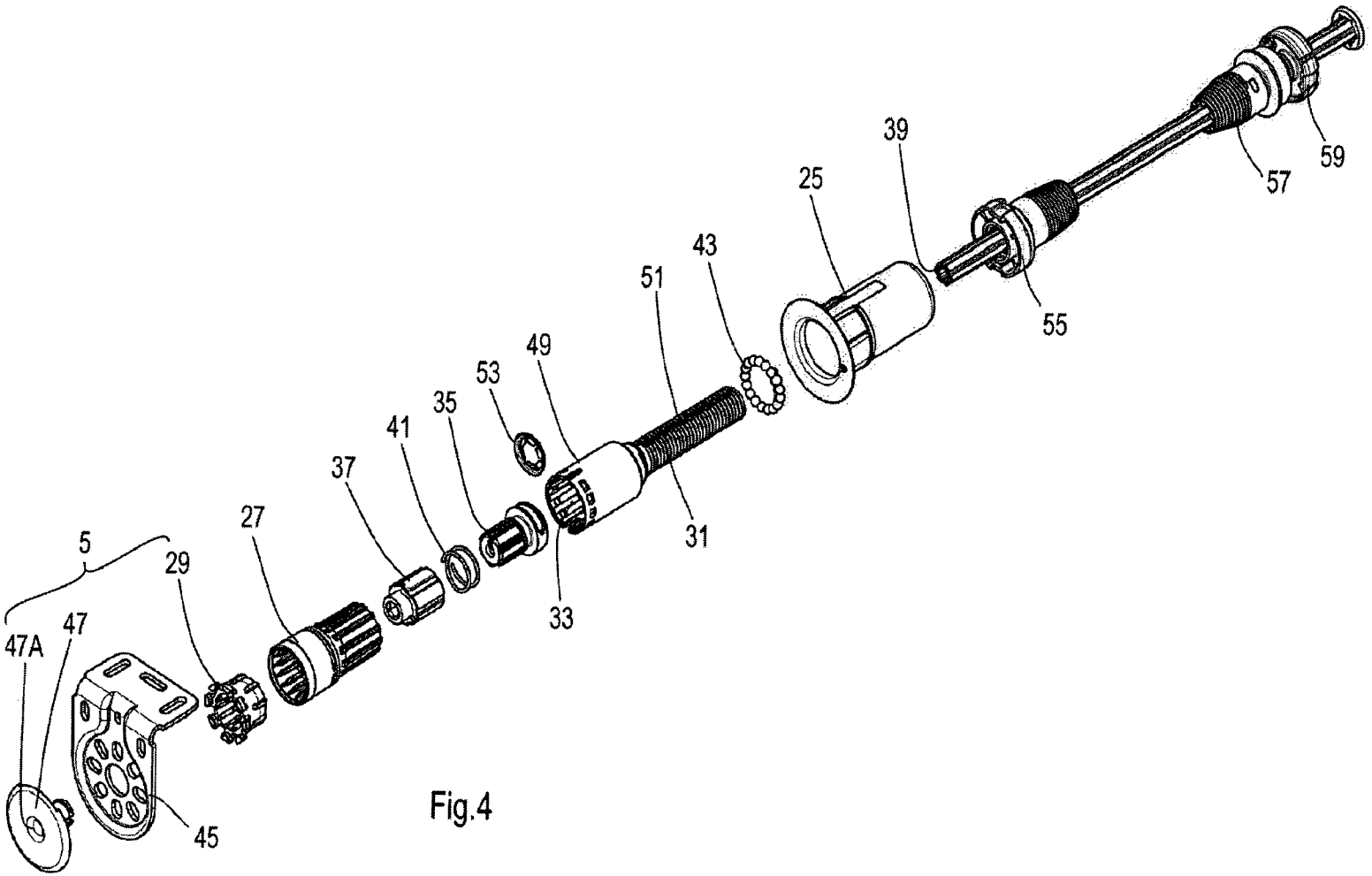
FIG. 4 is an exploded view of the counter balancing device visible in FIG. 2 together with auxiliary components.
Figure 5:
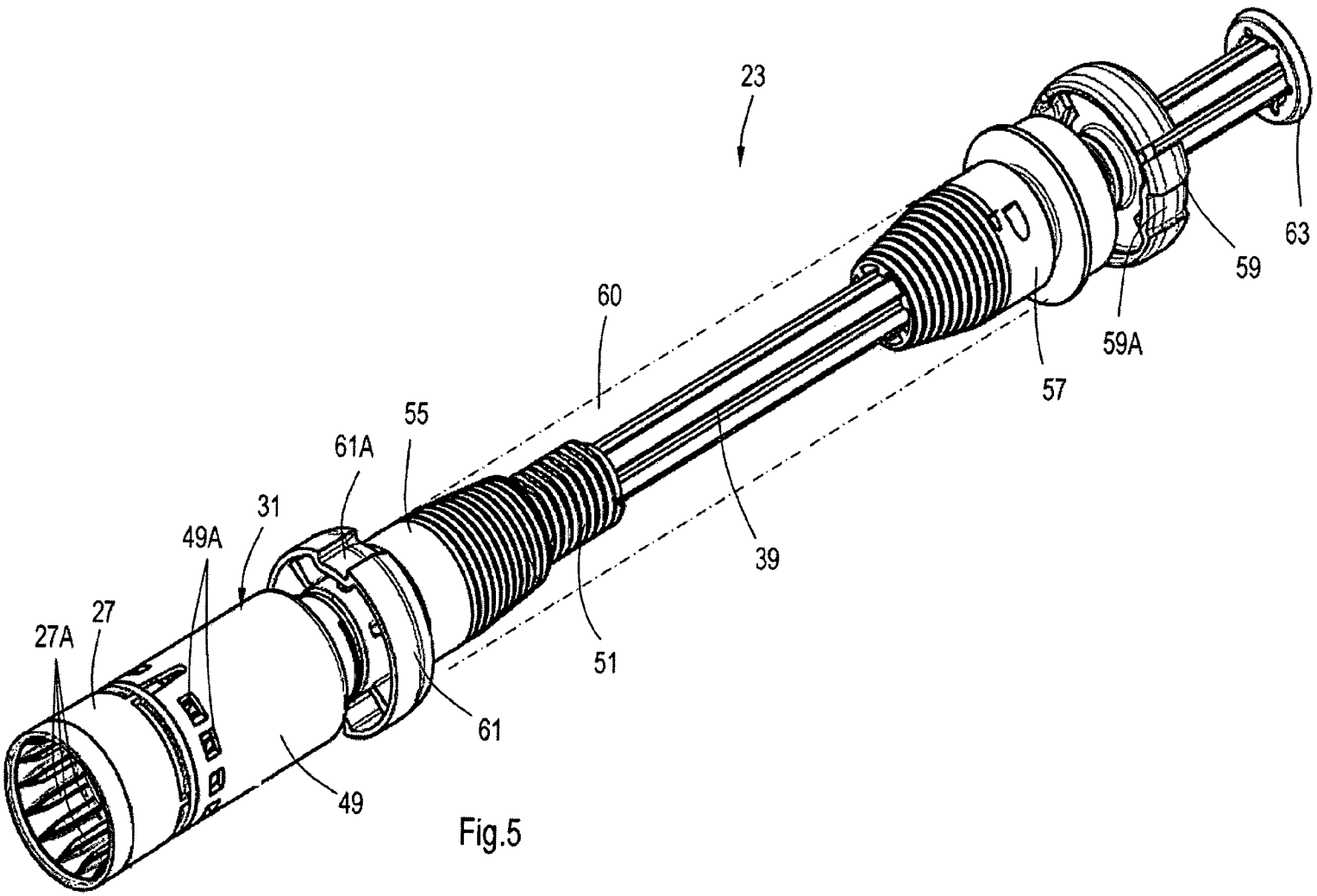
FIG. 5 shows the counter balancing device in assembled condition.

For a further description reference will now also be made to FIG. 4 which is an exploded view of the counter balancing device 23 of FIG. 2 with some other related parts of the roller shade mechanism. Starting from the left in FIG. 4, the first mounting bracket 5 is composed of a universal bracket body 45, which may also be employed for the second mounting bracket 7, the bracket adapter 29, already referred to in FIG. 3, and a bracket snap finger 47. The bracket snap finger is also provided with a central bore 47A to allow introduction of a tool. The bracket connector 27 when connected to the threaded shaft member 31 closes off the adjuster cavity 33 formed in an adjuster housing 49 formed at a first longitudinal end of the threaded shaft member 31. A threaded shaft 51 extends from a second longitudinal end of the threaded shaft member 31. Accommodated within the adjuster cavity 33, when closed off by the bracket connector plug 27, are the rod adapter 35, the rod adjuster 37 and the compression spring 41. The rod adapter 35 is fixedly and non-rotatable mounted to the central stationary rod 39 by means of a locking ring 53. The threaded shaft 51, upon assembly, will extend from an opposite end of the roller shaft end plug 25, with the central stationary rod 39 extending partly through a hollow centre of the threaded shaft 51. The threaded shaft 51 has a left-hand screw thread on its exterior, which upon assembly will be engaged by a spring winder 55 that is arranged to be freely rotatable about the central stationary rod 39 and to be engaged at all times with the threaded shaft 51. The threaded shaft 51 will conveniently have a length to allow for between about twenty five to thirty revolutions of the spring winder 55, which behaves like a nut through an engaging internal female screw thread. This feature will be discussed in more detail herein below. At another end of the stationary central shaft 39 sits a spring holder 57 that non-rotatably, but slidably engages the central stationary rod 39, which to this end carries splines on its outer circumference. Mating splines will be present within a central bore of the spring holder 57 (not shown, but conventional). A web bearing 59 may be arranged on an end of the central rod 39, which extends beyond the spring holder 57, to keep the stationary rod 39 central with respect to the hollow winding shaft 3 as illustrated in FIG. 2. The counterbalancing device 23 as made up from the above described components is shown in an assembled state in FIG. 5. Deleted from FIG. 4 for clarity and merely schematically indicated in FIG. 5 is a helically wound tension spring 60 that in use extends between the spring winder 55 and the spring holder 57. This helically wound tension spring 60 is itself a conventional component, well known to the skilled person. Calculation of the parameters, such as length and number of such helically wound tension springs is the subject of WO 2010/089118, which is hereby included by reference.

As shown in FIG. 5 the counter balancing device 23 on one end terminates with the bracket connector plug 27, which has internal ribs 27A for engaging the first mounting bracket 5. The spring winder 55 engages the threaded shaft 51 of the threaded shaft member 31 and the spring holder 57 slidably engages splines of the stationary central rod 39. A helically wound tension spring, as explained above and in WO 2010/089118, and indicated only schematically with reference numeral 60, connects between the spring winder 55 and the spring holder 57. The spring winder 55 has a flange portion 61 that has an axial groove 61A for slidably but non-rotatably engaging a mating formation on the inside of the roller shaft 3 (not shown, but conventional). The web bearing 59 rotatably sits on the stationary central rod 39 in a position beyond the spring holder 57, and also has an axial groove 59A for slidably engaging the mating formation on the inside of the roller shaft 3. To prevent the web bearing 59 from escaping from the end of the stationary central rod 39 a locking collar 63 is affixed to the central rod 39.

Figure 6:
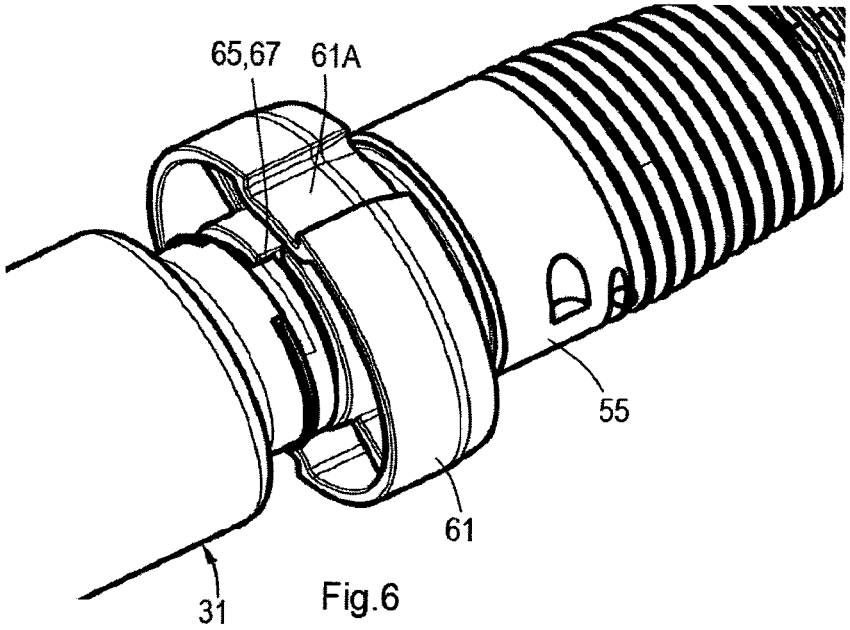
FIG. 6 is a detailed view of stopper means between a threaded shaft member and a spring winder being in abutment.

FIG. 6 shows the spring winder 55 at its end of travel with respect to the threaded shaft member 31. Abutting first and second stops 65, 67 at this point inhibit any further travel and relative further rotation of the spring winder 55. This position corresponds to the fully wound condition of the roller shade 1.

Figure 7:
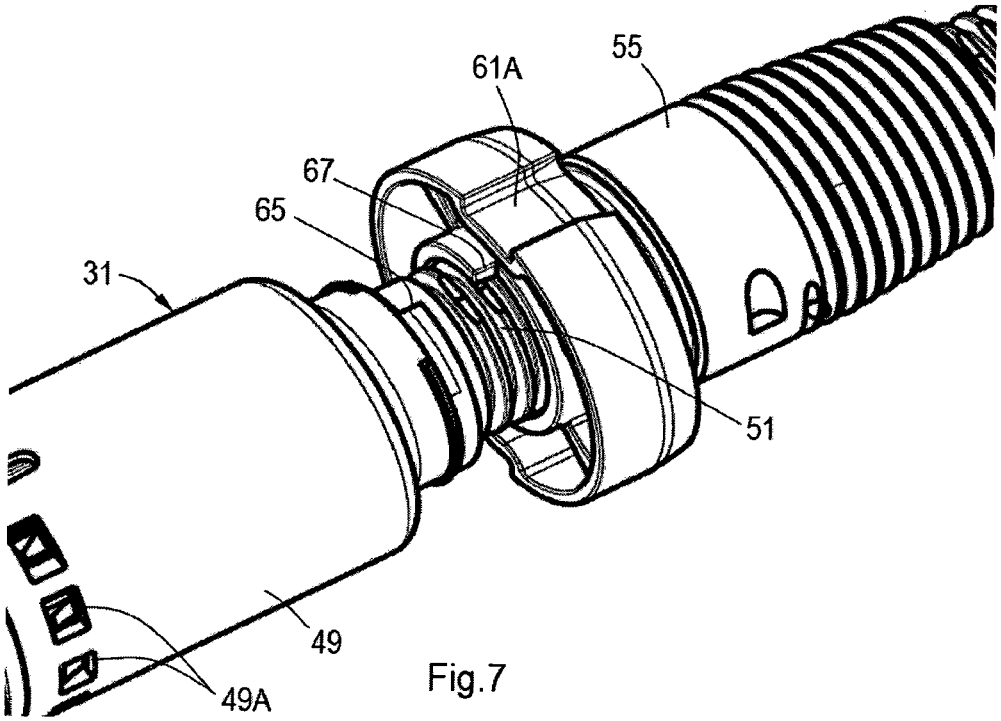
FIG. 7 is a detailed view showing the stopper means of FIG. 6 a few windings prior to engagement.

In FIG. 7 the spring winder 55 is shown in a position when it is still several winding away from the raised end position. In the view of FIG. 7 it can be clearly seen that the first stop 65 is integral with the threaded shaft member 31 and that the second stop 67 is integral with the spring winder 55.

Figure 8:
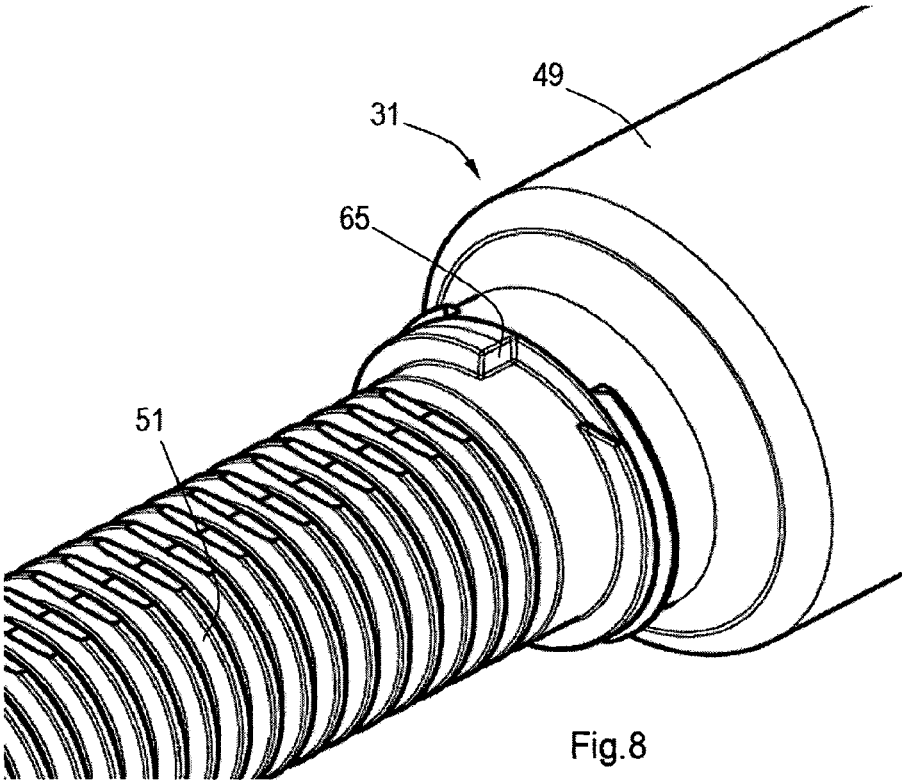
FIG. 8 is a detailed view of the stopper on the threaded shaft member.

FIG. 8 shows the threaded shaft member and its threaded shaft 51 from an opposite direction and further clarifies the position of the first stop 65 on the threaded shaft member 31.

Figure 9:
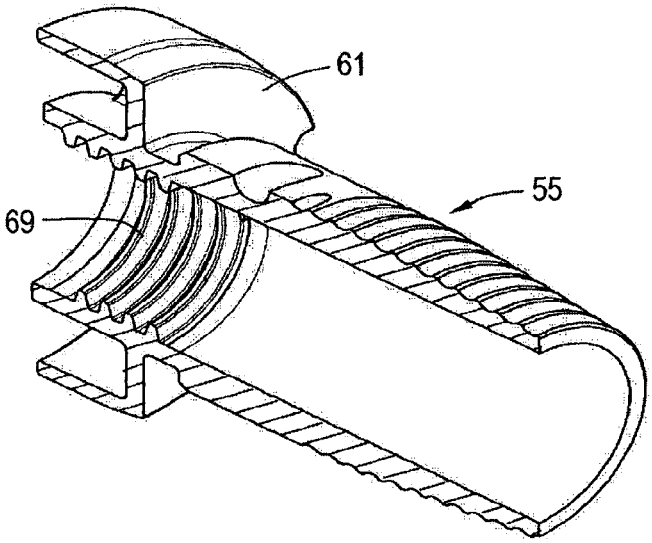
FIG. 9 is an isometric view of a longitudinally cross-sectioned spring winder.

FIG. 9 shows the spring winder 55 in a longitudinal cross section and shows a female screw thread 69 on an axial end portion of its inner through bore surface.

Figure 10:
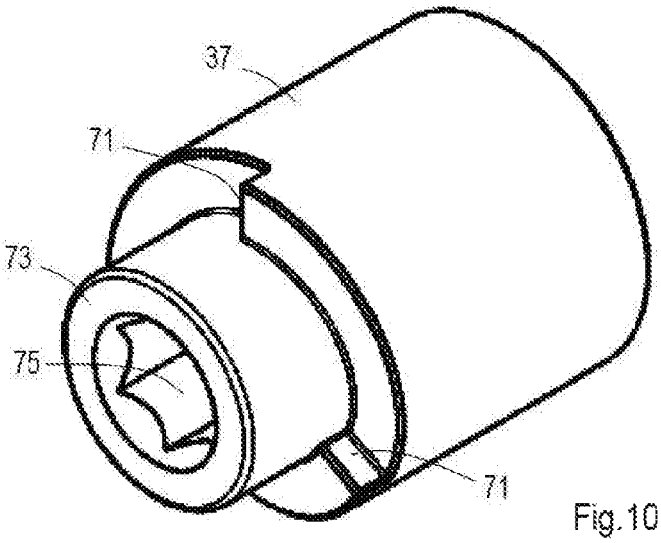
FIG. 10 is an isometric view of a rod adjuster.
Figure 11:
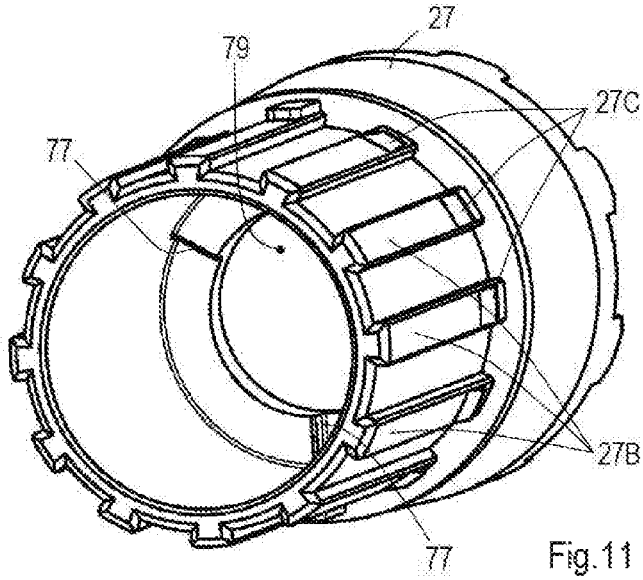
FIG. 11 is an isometric view of a threaded shaft member closure plug and mounting bracket connector.

Referring now to FIGS. 10 and 11 a further explanation follows of the cooperation between the rod adjuster 37 (FIG. 10) and the bracket connector plug 27 (FIG. 11). The rod adjuster as shown in FIG. 10 has ratchet teeth 71 on an axial face that surrounds a central boss 73 with a cavity 75 for receiving an adjustment tool, such as an Allen key. The bracket connector plug 27 has counter ratchet teeth 77 on an interior face and a central aperture 79 for permitting access to the boss 73 and tool cavity 75 of the rod adjuster 37. To allow this access with the roller shaft 3 in position on its first and second mounting brackets 5, 7, the first mounting bracket 5 has the central bore 47A in its bracket snap finger 47, as shown in FIGS. 3 and 4. It is further seen that the bracket connector plug 27 also has formations 27B on its exterior for non-rotatably mating with formations on the interior of the adjuster housing 49 of the threaded shaft member 31. Detents 27C are further provided to engage apertures 49A in the adjuster housing 49 for fixedly connecting the bracket connector plug 27 to the adjuster housing 49 of the threaded shaft member 31. In reference to FIG. 3 it will now be understood that ratchet teeth 71 of the rod adjuster 37 are urged into engagement with the counter ratchet teeth 77 of the bracket connector plug 27 by action of the compression spring 41. By engaging the cavity 75 by an Allen key (not shown, but conventional) the rod adjuster 37 can be rotated in a clockwise direction to adjust the stationary central rod 39 in the same direction and thereby increase the tension of the helically wound tension spring 60 by relative rotation of the spring holder 57. It is also possible to decrease the spring tension by pressing the Allen key inwardly so that the ratchet teeth 71 and counter ratchet teeth 77 can pass one another in an anti-clockwise direction. For safety reasons the ratchet teeth 71 and counter ratchet teeth 77 will always engage by the action of the compressing spring 41 when pressure on the Allen key is relieved. The helically wound tension spring 60 always is tensioned to urge the spring winder 55 with its second stop 67 into engagement with the first stop 65 on the threaded shaft member 31. This results from the spring tensioning direction and the left-hand screw thread on the threaded shaft 51. Effectively the abutting of the first and second stops 65, 67 determines the uppermost raised position of the bottom bar 15 an the portion of the flexible sheet member 9 that is wound onto the roller shaft 3. It will now be clear that this uppermost position can be very conveniently adjusted by engaging the bracket connector plug 27 and the bracket adapter 29 in different angular positions by means of their inter engaging ribs and serrations 27A, 29A as best seen in FIGS. 3 and 4. While this end stop feature with the spring winder 55 moving on a threaded shaft 51 and having mutually engaging first and second end stops 65, 67 will work with any pre-tensioned roller shade it is here described in connection with a roller shade that is fully balanced. Fully balanced means that the roller shade 1 can be adjusted in any position between fully raised and fully lowered by manually position the bottom bar 15 in any desired position. No brake means of any kind is required to retain the roller shade 1 in its adjusted position. The counter balancing device 23 is equipped with a helically wound tension spring 60 (FIG. 5) that is calculated in accordance with the teachings of WO 2010/089118 and adjusted to the appropriate pretension using the Allen key procedure described above. The selection of the helically wound tension spring 60 and its final adjustment allow a variable torque to be stored in the torsion spring to counteract the variable weight of the portion of flexible sheet member 9 that is depending from the roller shaft 3 in any of the adjusted positions between fully wound and fully unwound. It will be clear that also the weight of the bottom bar 15 that keeps the sheet member 9 taught and operational friction are also taken into account.

When this end stop feature is to be used in a spring force operated roller shade, it is only necessary to add a brake device of some kind to keep the shade in an adjusted position. The end stop feature, nonetheless, would also be very useful in such a traditional type of roller shade, because it stops the shade roller from overwinding when the shade is fully raised.

Thus is described a roller shade 1 including a flexible sheet member 9 having opposite parallel first and second edges 11, 13, and a roller shaft 3 rotatable in each of two opposite directions of rotation. The flexible sheet member 9 being attached along its first edge 11 to the roller shaft 3 in a longitudinal direction thereof, while the second edge 13 of the flexible sheet member 9 is freely depending from the roller shaft 3. In this way a raised position of the roller shade 1 is defined when the flexible sheet member 9 is fully wound about the roller shaft 3 and a lowered position is defined when the flexible sheet member 9 is fully unwound from the roller shaft 3. The roller shade 1 further comprises a counterbalancing device 23 for balancing a portion of the flexible sheet member 9 that is unwound from the roller shaft 3. This counterbalancing device 23 has means 60 for storing a variable torque that is complementary to a variable weight of the portion of flexible sheet member 9 that is depending from the roller shaft 3. The variable torque stored in the means 60 for storing variable torque prevents rotation of the roller shaft 3 due to the variable weight of the portion of flexible sheet member 9 depending from the roller shaft 3 in any position between the fully wound and the fully unwound position. The variable torque also increases as the second edge 13 of the flexible sheet member 9 is lowered. The means for storing variable torque notably includes a helically wound tension spring 60. The roller shade 1 also has the helically wound tension spring 60 operatively interposed between a stationary central rod 39 and the roller shaft. One end of the helically wound tension spring 60 is keyed to the stationary central rod 39 by a spring holder 57 and is keyed at an opposite end to the roller shaft 3 by a spring winder 55. The stationary central rod 39 extends axially through the spring winder 55.

The counterbalancing device 23 also includes a screw threaded shaft 51 connected axially to the stationary central rod 39. This screw threaded shaft 51 is engaged by a female screw thread 69 internally of the spring winder 55. The screw threaded shaft 51 also has a first stop 65 on an end thereof proximate to one axial end of the counterbalancing device 23. The spring winder 55 further has a second stop 67 positioned for abutment with the first stop 65 at an end of travel of the spring winder 55 with respect to the screw threaded shaft 51.

The counterbalancing device 23 further includes a rod adjuster 37 that axially connects the screw threaded shaft 51 to the stationary central rod 39. The rod adjuster 37 is arranged to allow relative angular adjustment between the screw threaded shaft 51 and the stationary central rod 39. The rod adjuster 37 is accommodated in an adjuster housing 49 that is closed by a bracket connector plug 27, to thereby define an adjuster cavity 33. The bracket connector plug 27 connects to a first mounting bracket 5 in a selective number of angular increments.

It is thus believed that the operation and construction of the present invention will be apparent from the foregoing description. To the skilled person in this field of the art it will be clear that the invention is not limited to the embodiments represented and described here, but that within the framework of the appended claims a large number of variants are possible. Also kinematic inversions are considered inherently disclosed and to be within the scope of the present invention. The terms comprising and including when used in this description or the appended claims should not be construed in an exclusive or exhaustive sense but rather in an inclusive sense. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. In this regard, the terms in the foregoing description and the appended claims, such as "upper", "lower", "right", and "left", have been used only as relative terms to describe the relationships of the various elements. Features which are not specifically or explicitly described or claimed may be additionally included in the structure according to the present invention without deviating from its scope.

The invention claimed is:

1. A counterbalancing device for a roller shade having a flexible sheet member and a roller shaft coupled to the flexible sheet member, said counterbalancing device comprising:

a rod extending within the roller shaft and including a first end and a second end opposite the first end;

a rod adjuster coupled to said first end of said rod, said rod adjuster configured to selectively rotate said rod;

a spring winder positioned adjacent to said first end of said rod, said spring winder being configured to rotate with the roller shaft;

a threaded shaft member onto which said spring winder is rotatably mounted; and a spring including a first spring end coupled to said spring winder such that said first spring end rotates with said spring winder, and a second spring end coupled to said rod such that said second spring end rotates with said rod;

wherein:

said rod adjuster is axially movable relative to said spring winder between a first axial position, and a second axial position at which said rod adjuster can rotate said rod to rotate said second spring end of said spring;

at least a portion of said rod adjuster is configured to be pressed into a cavity at least partially defined by said threaded shaft member when said rod adjuster is moved axially from the first axial position to the second axial position; and said spring winder engages said threaded shaft member as said spring winder rotates with the roller shaft.

2. The counterbalancing device of claim 1, further comprising a spring holder positioned adjacent to said second end of said rod, said spring holder coupling said second spring end of said spring to said rod such that said spring holder rotates with rotation of said rod to rotate said second spring end of said spring.

3. The counterbalancing device of claim 1, wherein said rod adjuster is disposed on a first axial side of said spring winder, and said spring holder is disposed on an opposed second axial side of said spring winder.

4. The counterbalancing device of claim 1, wherein said rod adjuster rotates relative to said threaded shaft member when rotating said rod.

5. The counterbalancing device of claim 1, further comprising an engagement member configured to engage a portion of said rod adjuster when said rod adjuster is disposed at the first axial position to restrict rotation of said rod adjuster.

6. The counterbalancing device of claim 5, wherein, when said rod adjuster is axially moved from the first axial position to the second axial position, said engagement member disengages from said portion of said rod adjuster to allow said rod adjuster to rotate said rod.

7. The counterbalancing device of claim 1, wherein said first spring end is positioned closest to said first end of said rod and said second spring end is positioned closest to said second end of said rod.

8. The counterbalancing device of claim 1, wherein rotation of said rod by said rod adjuster is restricted when said rod adjuster is disposed at the first axial position.

9. The counterbalancing device of claim 8, wherein rotation of said rod by said rod adjuster is restricted such that said rod can only be rotated in one direction when said rod adjuster is disposed at the first axial position.

10. The counterbalancing device of claim 1, wherein said rod adjuster is configured to rotate said rod to adjust a spring force of said spring.

11. A counterbalancing device for a roller shade having a flexible sheet member and a roller shaft coupled to the flexible sheet member, said counterbalancing device comprising:

a rod extending within the roller shaft and including a first end and a second end opposite the first end;

a spring through which said rod extends, said spring including a first spring end positioned closest to said first end of said rod, and a second spring end positioned closest to said second end of said rod;

a spring winder configured to rotate with the roller shaft, said first spring end of said spring being coupled to said spring winder to rotate with said spring winder;

a threaded shaft member onto which said spring winder is rotatably mounted;

a spring holder configured to rotate with said rod relative to the roller shaft, said second spring end of said spring being coupled to said spring holder to rotate with said spring holder; and a rod adjuster coupled to said first end of said rod, said rod adjuster configured to selectively rotate said rod relative to said threaded shaft member;

wherein, when said rod is rotated via rotation of said rod adjuster, said spring holder and said second spring end of said spring rotate with said rod.

12. The counterbalancing device of claim 11, wherein said rod adjuster is disposed on a first axial side of said spring winder, and said spring holder is disposed on an opposed second axial side of said spring winder.

13. The counterbalancing device of claim 11, wherein said rod adjuster is axially movable relative to said spring winder between a first axial position, and a second axial position at which said rod adjuster can rotate said rod to rotate said second spring end of said spring.

14. The counter balancing device of claim 13, wherein rotation of said rod by said rod adjuster is restricted when said rod adjuster is disposed at the first axial position.

15. The counterbalancing device of claim 14, wherein rotation of said rod by said rod adjuster is restricted such that said rod can only be rotated in one direction when said rod adjuster is disposed at the first axial position.

16. The counterbalancing device of claim 13, wherein at least a portion of said rod adjuster is configured to be pressed into a cavity at least partially defined by the threaded shaft member when said rod adjuster is moved axially from the first axial position to the second axial position.

17. The counterbalancing device of claim 16, wherein said rod adjuster is configured to rotate relative to said threaded shaft member and said spring winder when rotating said rod.

18. The counterbalancing device of claim 13, further comprising an engagement member configured to engage a portion of said rod adjuster when said rod adjuster is disposed at the first axial position to restrict rotation of said rod adjuster.

19. The counterbalancing device of claim 18, wherein, when said rod adjuster is axially moved from the first axial position to the second axial position, said engagement member disengages from said portion of said rod adjuster to allow said rod adjuster to rotate said rod.

20. The counterbalancing device of claim 11, wherein said rod adjuster is configured to rotate said rod to adjust a spring force of said spring.

21. A roller shade, comprising:

a flexible sheet member;

a roller shaft coupled to said flexible sheet member;

a rod extending within said roller shaft and including a first end and a second end opposite the first end;

a rod adjuster coupled to said first end of said rod, said rod adjuster configured to selectively rotate said rod;

a spring winder positioned adjacent to said first end of said rod, said spring winder being configured to rotate with said roller shaft;

a threaded shaft member onto which said spring winder is rotatably mounted; and a spring including a first spring end coupled to said spring winder such that said first spring end rotates with said spring winder, and a second spring end coupled to said rod such that said second spring end rotates with said rod;

wherein:

said rod adjuster is axially movable relative to said spring winder between a first axial position, and a second axial position at which said rod adjuster can rotate said rod to rotate said second spring end of said spring;

at least a portion of said rod adjuster is configured to be pressed into a cavity at least partially defined by said threaded shaft member when said rod adjuster is moved axially from the first axial position to the second axial position; and said spring winder engages said threaded shaft member as said spring winder rotates with said roller shaft.

22. The roller shade claim 21, wherein said rod adjuster rotates relative to said threaded shaft member when rotating said rod.

* * * * *